United States Patent [19]

Takashima et al.

[11] 4,294,902

[45] Oct. 13, 1981

[54] IMAGE FORMATION METHOD HAVING TRANSLUCENT PARTICLES CONTAINING A COLORING AGENT AND A COLORLESS DYE FORMER

[75] Inventors: Yuji Takashima, Osaka; Eisuke Ishida, Nara; Hisanori Nishiguchi, Neyagawa; Kimiaki Yoshino, Hirakata, all of Japan

[73] Assignee: Matsushita Electric Industrial Co., Ltd., Osaka, Japan

[21] Appl. No.: 934,503

[22] Filed: Aug. 17, 1978

Related U.S. Application Data

[63] Continuation of Ser. No. 741,022, Nov. 11, 1976, abandoned.

[30] Foreign Application Priority Data

Nov. 12, 1975 [JP] Japan ..... 50-136505
Nov. 12, 1975 [JP] Japan ..... 50-136506
Nov. 12, 1975 [JP] Japan ..... 50-136507

[51] Int. Cl.[3] ..... G03G 13/08; G03G 13/16

[52] U.S. Cl. ..... 430/45; 430/47; 430/126

[58] Field of Search ..... 96/1 R, 1.2, 1.5, 1 SD; 430/102, 100, 42, 45, 47, 126

[56] References Cited

U.S. PATENT DOCUMENTS

| | | | |
|---|---|---|---|
| 2,758,524 | 8/1956 | Sugarman | 430/102 |
| 2,940,847 | 6/1960 | Kaprelian | 430/102 |
| 3,071,645 | 1/1963 | McNaney | 96/1 SD |
| 3,775,103 | 11/1973 | Sadamatsu et al. | 96/1 R |
| 3,880,656 | 4/1975 | Nagashima et al. | 96/1.2 |
| 3,900,318 | 8/1975 | Zographos | 96/1.2 |
| 3,926,628 | 12/1975 | Howjo | 96/1 R |
| 4,145,300 | 3/1979 | Hendriks | 96/1 SD |

*Primary Examiner*—Richard L. Schilling
*Assistant Examiner*—John L. Goodrow
*Attorney, Agent, or Firm*—Wenderoth, Lind & Ponack

[57] ABSTRACT

The present invention is directed to a method and an apparatus for formation of images by particles on a photosensitive plate. Particles employed are translucent, whereby a charge holding the particles to the photosensitive plate may be efficiently removed from selected particles by image-wise light from an original document, etc., so ensuring production of well-defined images. For production of color images, there is employed a panchromatized plate and particles which are transparent to different types of light and have associated therewith dye material permitting production of clearly defined color images, it being made possible to obtain a color copy of an original document in a process requiring only one exposure stage and only one development stage.

10 Claims, 13 Drawing Figures

IMAGE FORMATION METHOD HAVING TRANSLUCENT PARTICLES CONTAINING A COLORING AGENT AND A COLORLESS DYE FORMER

This is a continuation, of application Ser. No. 741,022, filed Nov. 11, 1976, now abandoned.

The present invention relates to a method for formation of images which makes use of the phenomenon of photoelectric image development in photoconductive material employed as base material and of the optical properties of transparent particles which are employed as image-defining material, and to an apparatus embodying the image-formation method of the invention.

A representative conventional method of defining images by means of particles is the so-called electroprintmarking method. In this method, particles of photoconductive material are scattered on one surface, referred to below as the upper surface, of a board or plate of conductive material which is held at ground potential, after which the particles are electrically charged to a potential which is different from ground material, whereby the particles are held firmly to the plate of conductive material by the force of electrostatic attraction. The particles are then exposed to image-wise light defining an image to be produced. When the particles are exposed to image-wise light produced by directing light through a black and white original document, for example printed letters on a sheet of transparent paper, the light incident to those particles, in terms of direction of travel of light rays constituting the image-wise light, is in line with those portions of the original document which are not marked with letters, but light not incident to those particles, is in line with letter-carrying portions of the original document. In this sense, there is a distinction herein between the term 'exposure,' which is taken to mean direction of a complete band of light carrying a complete band of image information onto the entire surface or an entire band of a conductive plate having photoconductive particles applied thereon, and the term 'irradiation', which is taken to mean impingement of light on individual particles applied on the upper surface of a conductive plate. Theoretically, as a result of such exposure, whereas charge on non-irradiated particles remains unchanged, the resistance of irradiated particles is lowered, and charge thereon consequently leaks through the conductive plate to ground and is largely or completely removed, i.e., electrostatic attraction between the irradiated particles and the conductive plate becomes very small, this phenomenon being sometimes referred to as 'photo-attenuation.' Thus, it is theoretically possible to selectively remove the irradiated particles by application of an electrical or mechanical force which acts in a direction away from the upper surface of the conductive plate and is applied generally evenly over the whole area of the plate upper surface, the non-irradiated particles remaining in bonded attachment to the plate and defining a pattern which corresponds to the content of the original document.

In this process there is obviously a problem with respect to selection of a correct value of force for removal of particles from the plate of conductive material and accurate application of this force, since in order to obtain a sharp image it is necessary to effect removal of only irradiated particles and to leave on the plate all the particles which have not been irradiated. If the charge on irradiated particles can be brought to zero while charge on non-irradiated particles remains unchanged there is a certain degree of latitude with respect to the precise value of the particle-removal force, which may be any one of a comparatively broad range of values. In order to achieve such efficiency of photo-attenuation it is necessary that all the particles initially applied on the plate of conductive material have the same or closely similar photo-attenuation characteristics, i.e., that electrical properties of all particles be affected in more or less the same manner by light, and also that there be good ohmic contact between the particles and the conductive plate. However, with the present state of technology, imparting uniform photo-attenuation characteristics to particles and grading particles in order to obtain batches of particles having generally uniform characteristics are extremely slow and costly processes. Further, to achieve good ohmic contact between particles and the conductive plate, the conductive plate must be very smooth, and while the requisite smoothness can be achieved under laboratory conditions this smoothness is very difficult to achieve in an industrial, mass-production process. In other words, although it is theoretically possible to obtain sharp images defined by particles by conventional processes, in practical equipment employed hitherto, it has been found difficult or impossible to guarantee the quality of results.

Also, known materials generally employed for image-defining particles in conventional methods include selenium, zinc oxide, or cadmium oxide, which are opaque. These conventional methods have a disadvantage in that since particles are generally spherical in shape, for any one particle, the portion of the particle which is closer to the conductive plate is inevitably less exposable to light than the portion thereof which is further removed from the plate and closer to the source of image-wise light. As a result, there is reduced efficiency of photo-attenuation of irradiated particles by the image-wise light. The difference between the charge on irradiated particles and the charge on irradiated particles after exposure is therefore less, and there is consequently less latitude in the permissible value of particle-removal force subsequently imposed on all particles. This problem is further aggravated in areas of particles in locations corresponding to edge portions of letters or figures of an original document. Since the particles, are opaque and scatter light to a certain extent, there is slight photo-attenuation of particles which are out of direct line with light rays coming from edge portions of letters or figures of an original document, but are adjacent to particles on which these rays of light impinge. Hence, there is even further reduction in latitude with respect to the particle-removal force imposed on particles subsequent to exposure, and in practical equipment, it is often impossible to constantly maintain this force within requisite limits. Consequently, by removal of particles which were not directly irradiated or by failure to remove directly irradiated particles, poor definition or resolution in copies of original documents may result.

In conventional methods for image formation by particles, production of a color image presents further problems. To produce a color image in a process requiring only one exposure and only one development stage, it is necessary to impart specific spectral characteristics to different particles. However, suitable sensitizers for selectively imparting blue, green or red sensitivity to different particles while maintaining uniform photo-attenuation characteristics thereof have not been hitherto available, and production of good-quality color images has therefore been considered to be particularly difficult.

To produce a color image by conventional electrophotocopying methods, e.g., xerography or the electrofax method, it is necessary to effect exposure of electrophotosensitive material three times, once through a blue filter, once through a green filter, and once through a red filter, and then effect three development processes employing yellow, magenta, or cyan toner, in correspondence to the different latent image portions produced as a result of exposure of the electrophotosensitive material through the different filters. It is necessary to effect charging of the material prior to each exposure thereof through a particular filter. In other words, the process is very slow and complicated, and equipment for producing color copies of colored original documents is therefore rendered extremely complex and costly.

It is accordingly an object of the invention to provide an image formation method permitting production of images having good resolution.

It is another object of the invention to provide a method for image formation permitting production of color images of colored original documents without use of color separation filters.

It is a further object of the invention to provide a method and apparatus permitting production of good quality color prints of colored original documents in a process requiring only one exposure stage and only one development stage.

It is yet another object of the invention to provide image-defining particles suited for employment in the method of the invention.

In accomplishing these and other objects according to the present invention, there is employed a photosensitive base material which incorporates at least a photoconductive material and particles for defining an image. The particles are transparent or translucent and use is made of the optical characteristics of these materials in the following manner. The translucent or light transmitting particles are applied on the photosensitive base material, are caused to adhere thereto by the force of electrostatic attraction, and then are exposed to an image-wise light, resulting in photo-attenuation of irradiated particles i.e., releasing irradiated particles from the force of electrostatic attraction by means of the light, which are then selectively removed by application of an electrical or a mechanical force. The non-irradiated particles are in electrostatically adhered attachment to the base material and defining thereon an image. After this, a fixing process is effected, if necessary, to obtain a finished print.

To produce a color image, an equal mixture of particles is employed. These particles have different spectral characteristics and different color development ability. Each of the particles is transparent to light of a wavelength corresponding to one of the primary colors of the addition color process and is able to develop a primary color of the subtraction color process, whereby subsequent to exposure of the various mixed particles to image-wise light coming from a colored original document and subsequent to a development stage, the particles remaining in attachment to the base material and occupy an area which corresponds to a particular addition-process primary color portion of the original document. These particles are able to develop the two primary colors of the subtraction process, which in combination, give the particular addition-process primary color of the corresponding portion of the original document. It is consequently made possible to produce a color print of a colored original document by a simple and rapid process.

A better understanding of the present invention may be had from the following full description thereof when read in reference to the attached drawings in which like numbers refer to like elements, and FIGS. 1 through 4 are schematic drawings illustrating the image formation method according to one embodiment of the invention;

Figure 1:
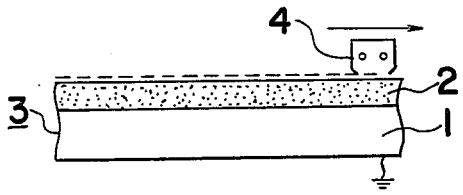
Figure 2:
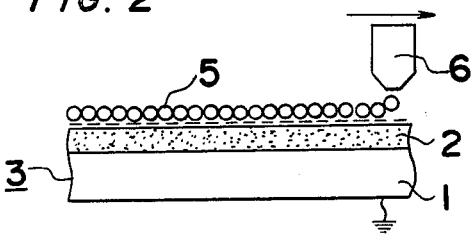

Referring initially to FIG. 1, according to the invention there is employed a photosensitive plate 3 consisting of a conductive base 1 of a photoconductive layer 2 of zinc oxide, selenium, or similar material applied to a conductive support base 1 of aluminum, or metallized paper, etc. The photosensitive plate 3 is electrically charged in a dark location by means of a corona discharge unit 4, for example. If the photoconductive material of the layer 2 is n-type semiconductor material such as zinc oxide, the plate 3 is negatively charged, and if the material of the layer 2 is p-type semiconductor material such as selenium, the plate 3 is positively charged. After this, as shown in FIG. 2, translucent particles 5 are spread in an approximately single layer on the outer surface of the photoconductive layer 2 by a particle dispersal hopper 6 or similar means, and the plate 3 being charged, are caused to adhere thereto by the force of electrostatic attraction.

Figure 3:
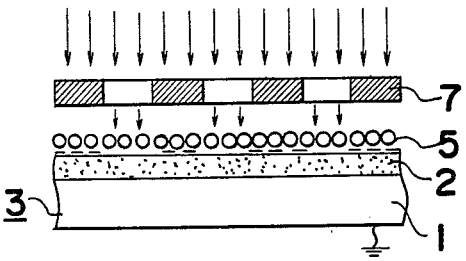

Next, as illustrated in FIG. 3, the whole unit, i.e., the plate 3 together with the particles 5, is exposed to image-wise light which is directed onto the particles 5 side of the plate 3 and is produced for example by directing light through a transparent original document 7, so resulting in photo-attenuation of irradiated particles and consequent reduction or elimination of electrostatic force holding the irradiated particles 5' to the plate 3. Needless to say, the image-wise light may also be light reflected from an opaque original document, light transmitted through an optical fibre tube, or by light emitted by a cathode ray tube or pulse light source such as employed in a facsimile transmission system.

Figure 4:
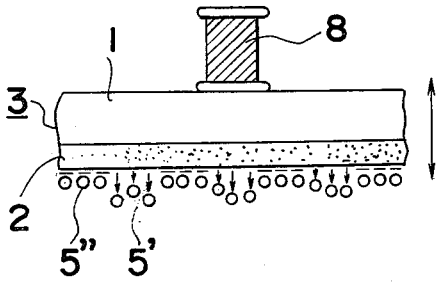

Next, as depicted in FIG. 4, the photosensitive plate 3 is turned over, so that the particle-carrying side thereof is lowermost, and there is applied to the rear surface thereof, which is now uppermost, a vibratory force sufficient to cause only the irradiated and photo-attenuated translucent particles 5' to fall off, thereby producing a developed image defined by the non-irradiated particles 5''. This vibratory force is suitably applied by an electromagnetic vibrator 8, or similar means.

Figure 5:
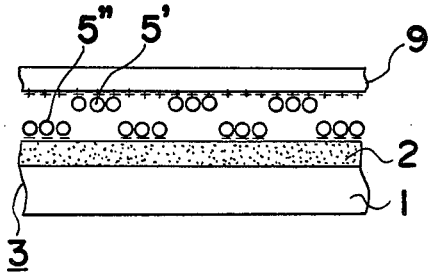
FIGS. 5 and 6 are schematic drawings illustrating alternative methods of image development according to the present invention.

According to another developing method, illustrated in FIG. 5, a sheet of dielectric material 9, for example plastic film, which is positively charged when photoconductive layer 2 is negatively charged, is brought close to, or into pressure contact with the exposed plate 3, and then moved away therefrom, irradiated particles 5' being held by electrostatic attractive force to the dielectric material 9 and so detached from the plate 3 when the dielectric material 9 is moved away from the plate 3. This method of development has the advantage that as well as a positive image obtained on the plate 3 there is also obtained a negative image of the original document on the sheet of dielectric material 9.

Figure 6:
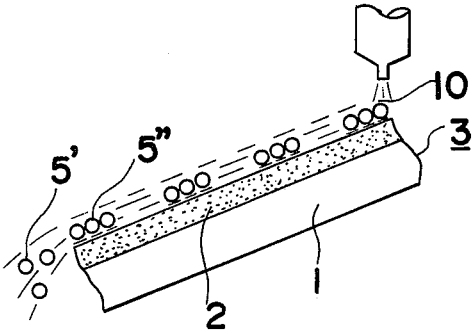

Alternatively, as illustrated in FIG. 6, the exposed plate 3 may be inclined and an insulating liquid 10 for example mineral turpentine or iso-octane, poured over the plate 3, to effect removal of irradiated particles 5' by the combined action of flow pressure and attractive force exerted by the solution 10. It is also possible to develop the exposed plate 3 by an air-jet which removes the particles 5' through which light has passed, or by means of a magnetic brush, i.e., a brush having magnetic particles of iron powder or similar material attached thereto, these magnetic particles exerting an attractive force sufficient to cause attachment of the particles 5' through which light has passed thereto, but insufficient to cause detachment of non-irradiated particles 5'' from the plate 3.

The particle image obtained in the abovedescribed manner may of course be employed for a repeated display, using a cathode ray tube, display screen, and similar known means.

A permanent print may be obtained by fixing the particle image on an image-receiver, which may be constituted by a separate sheet of printing paper, for example, or by the plate 3 itself. Various methods of fixing may be employed depending on the types and qualities of the transparent particles and photosensitive plate employed, examples being as follows.

Figure 7:
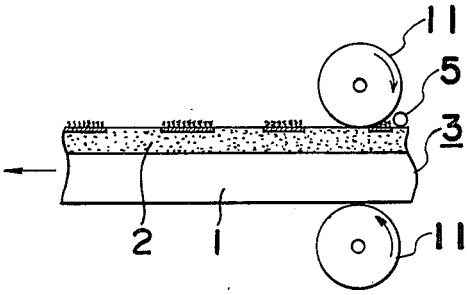
FIGS. 7 and 8 are schematic drawings illustrating alternative methods of fixing images according to the invention.

Referring to FIG. 7, the exposed and developed plate 3 is passed through a pressure unit 11, which is constituted by a pair of rolls, for example, and fixes the non-irradiated particles 5'' in a pattern defining the image of the original document 7. When this is done it does not matter of course if the particles 5'' are crushed.

Another fixing method is to cause fusion of either the photoconductive layer 2 or of the non-irradiated translucent particles 5'' by means of a solvent or heating means.

Alternatively, if, as described in greater detail below, the translucent particles contain colored subliming dye material, a fixed colored image may be obtained by heating the image-defining particles 5'' or heating and applying pressure on the particles 5'' and the photosensitive plate 3. Further, the translucent particles 5 can contain, for example, a colorless subliming dye such as Michler's ketone and a colorless leuco-dye such as leucomethylene blue. These dyes develop by reaction with a developer which is constituted, for example, by an electron acceptor material such as activated clay or bis-phenol A. By providing such a developer beforehand in the translucent particles or in the photosensitive plate material, the dye can be caused to react with the developer by means of a heating agent or a solvent, whereby a colored image constituted by the dye material, is produced on the photosensitive material.

Figure 8:
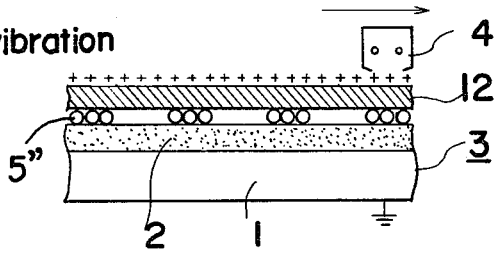

To fix the image on separate image-receiver material, as shown in FIG. 8, a sheet of paper or other image-receiver material 12 is pressed into firm contact with image-defining particles disposed on the exposed and developed plate 3, and a corona discharge unit 4 which is located at the rear side of the image-receiver material 12, i.e., the side thereof which is further removed from the plate 3, charges the image-receiver material 12 to a polarity such that the image-defining particles 5'' are caused to adhere to the material 3 instead of to the photoconductive layer 2, after which the image-receiver material 12 is moved away from the plate 3. There may be subsequently effected a fixing process for fixing the transferred image on the material 12, making use of pressure rolls or similar means such as described above. Another transfer method is to prepare a sheet of image-receiver material having, an adhesive layer such as butyl rubber on a base of paper, etc., effect transfer of the particle image thereonto by means of pressure, and then fix the image on the image-receiver material, if necessary, employing for example one of the above-described fixing processes. In this case as well, if colorless leuco-dye or colorless subliming dye materials are included in the translucent particles, a developer is included in the image-receiver material.

The description continues with reference to another embodiment of the invention which permits production of a color copy with only one exposure and only one development state. According to this embodiment, particles employed to define images have imparted thereto specific spectral characteristics and also the ability to produce specific colors. There are employed at least three sets of translucent particles which are thoroughly mixed before application thereof on the photoconductive layer 2 of the plate 3. Any one particle of any one set is transparent to electromagnetic radiation of a wavelength corresponding to one of the primary colors of the addition color process, the particle suitably being opaque to the other two primary colors of the addition process, and the particle being also able to develop at least one of the three colors of the subtraction colour process which in combination with another colour of the subtraction colour process gives the primary color of the addition color process to which the particle is transparent. In more detail, in one set of particles there are employed particles which are transparent only to red light and also contain a colorless dye able to produce the color cyan. In another set, the particles are transparent only to green light and contain a colorless dye which can produce the color magenta. Another set contains particles which are transparent only to blue light and include a colorless dye which can produce the color yellow. When a mixture of such particles is employed, the photosensitive base material is suitably panchromatically sensitized.

Figure 9:
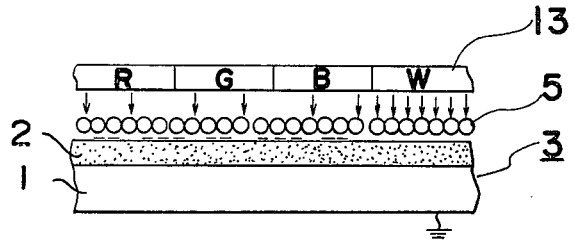
FIGS. 9 and 10 are schematic drawings illustrating an image formation according to another embodiment of the invention.
Figure 10:
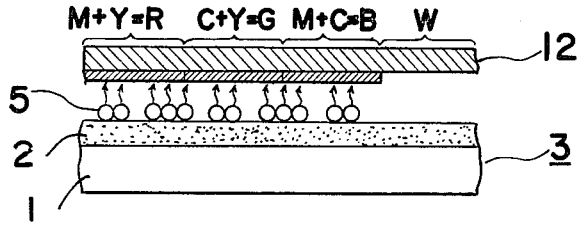

Referring to FIGS. 9 and 10, principles of color copy formation by particles according to the invention are as follows. Particles 5 including, in generally equal proportions, particles 5R which are transparent to red light and include or have coated thereon cyan colorless dye. Particles 5G which are transparent to green light and include or have coated thereon magenta coloring material, and particles 5B which are transparent to blue light and include or have coated thereon yellow coloring material. These particles are thoroughly mixed and applied to a panchromatically sensitized photosensitive base plate 3, to which the particles 5 are caused to adhere by one of the methods described in reference to FIGS. 1 and 2. The particles 5 and plates 3 are then exposed to light which is directed through a color reversal film or similar element constituting a colored original 13. The particles being thoroughly mixed before application on the plate 3, on any given portion of the plate 3 there is a substantially even number of particles 5R, 5G, and 5B. Thus, as a result of exposure, in an area of particles 5 on which red light coming from a red portion of the original 13 is incident, there is photo-attenuation of the particles 5R only, and particles 5G and 5B continue to be firmly held by electrostatic attraction to the plate 3. Similarly, in areas corresponding to green portions of the original 13, there is photo-attenuation of the particles 5G, while the particles 5R and 5B remain adhered to the plate 3, and in areas corresponding to blue portions of the original 13 the particles 5B are photo-attenuated, but the electrostatic force holding the particles 5R and 5G to the plate 3 is maintained. In an area corresponding to a white portion of the original 13 there is of course photo-attenuation of all the particles 5. Subsequent to removal of particles 5 through which the light has passed, therefore, by application of vibratory force, for example, in areas corresponding to red portions of the original 13 there remain in contact with the plate 3 only particles 5G and 5B, respectively able to produce the colors magenta and yellow, which in combination give the color red. In areas corresponding to green portions of the original 13 there remain in contact with the plate 3 only particles 5R and 5B, respectively able to produce the colors cyan and yellow, which in combination give the color green, in areas corresponding to blue portions of the original 13 there remain in contact with the plate 3 only particles 5R and 5G, respectively able to produce the colors cyan and magenta, which in combination give the color green, and in areas corresponding to white portions of the original 13 no particles 5 remain in contact with the plate 3. Therefore, by bringing the various particles 5R, 5B, and 5G into contact with developing agent in order to develop the subtraction process primary colors associated with the different particles 5, there may be produced an accurately colored copy of the colored original 13. This development process may be accompanied by or may be effected as a result of transfer of the particle image onto a sheet of paper or other image-receiver material 12 as illustrated in FIG. 10.

It will be noted that according to the method of the invention, both in production of monochromatic images and in production of multicolor images, since translucent or transparent image-defining particles through which light has passed or has not passed are employed, it is therefore made possible to obtain images with excellent resolution and definition of outlines. Another major advantage of the invention is that it is made possible to obtain a full color copy in a process which takes little or no more time than is required in order to obtain a black and white image in a conventional process, and which requires use of only very simple apparatus.

Figure 11:
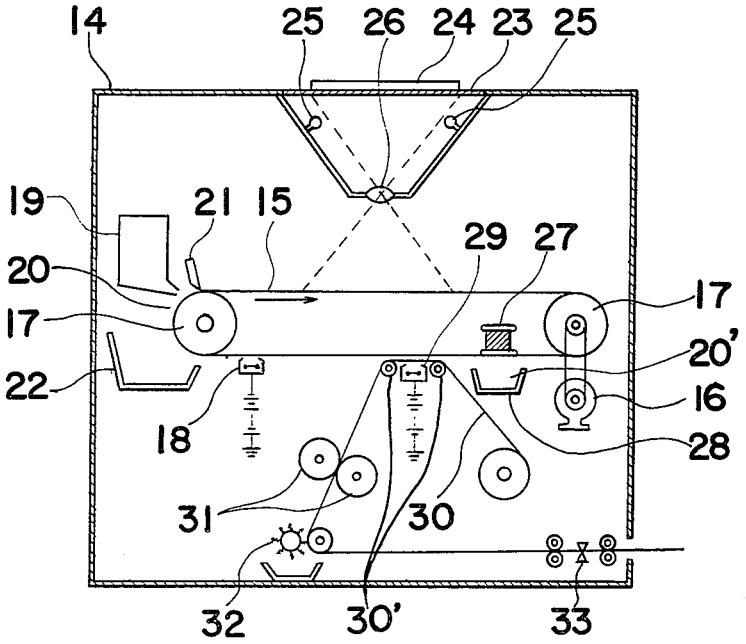
FIG. 11 is a schematic cross-sectional view showing an image production apparatus according to one embodiment of the invention.

An example of image-formation apparatus according to one embodiment of the invention is shown in FIG. 11 to which reference is now made. The apparatus comprises a main housing 14 in which a horizontally disposed endless belt 15, having an outer surface construction like that of the above-described plate 3, is driven by a motor 16 acting through one or more drive rolls 17. Before coming to the upper stretch of the belt 15, successive portions of the belt 15 are positively or negatively charged by a corona discharge unit 18 which is provided in a lower portion of the interior of the main housing 14. After changing, translucent particles 20 containing subliming dye material are scattered on the belt 15 by a particle dispersal hopper 19 provided near the rear end of the upper stretch of the belt 15. Excess particles 20 are then scraped off the belt 15 by a doctor knife 21, whereby there is formed an approximately single layer of particles 20 on the belt 15. Excess particles 20 removed from the belt 15 fall into a particle recovery bin 22 provided below the rear end of the upper stretch of the belt 15. When particles 20, held to the belt 15 by electrostatic force, are brought to an exposure station which is located at a generally central portion of the upper stretch of the belt 15, the particles 20 are exposed to image-wise light carrying the image of an original document 24 which is supported on a glass support 23 located in an upper wall portion of the main housing 14 and is illuminated by lighting means 25, the image-wise light being focussed on the particles 20 by a lens system 26. The belt 15 is suitably held stationary during the exposure process, and drive thereof is recommenced upon completion of the exposure process. When the exposed particles 20 are brought to the lower stretch of the belt 15, and are therefore below the lowwer surface of the belt 15, the belt 15 is vibrated by a magnetic vibrator 27, which is provided above the lower stretch of the belt 15, whereby particles through which light has passed are shaken off the belt 15, these particles being caught in a particle catcher 20′ provided in a lower portion of the main housing 14, the remaining particles 20 now defining an image corresponding to the content of the original document 24.

After this, the particle image is brought to a transfer station which comprises a corona discharge unit 29 and at which the particle image is transferred onto paper or similar image-receiver material 30 which is supplied from a continuous supply roll 30′ to and past the transfer station by pressure and heating rolls 31 which also serve to fix the image on the image-receiver material 30 and guide the material 30 to the exterior of the apparatus. Before leaving the apparatus, the image-receiver is cleaned by a cleaning brush 32 and is then cut into a suitable length for a finished print by a cutter unit 33. After passing the transfer station, the belt 15 is passed through a charge removal station, not indicated, and is then recharged by the corona discharge unit 18, in preparation for production of another copy of the same or another original document.

The description continues with more detailed reference to materials employable in the method of the invention and to fabrication of these materials.

Figure 12:
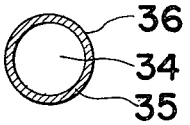
FIGS. 12 and 13 are schematic cross-sectional views illustrating construction of translucent particles employing the method and apparatus of the invention.
Figure 13:
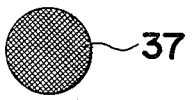

Translucent or transparent particles suitable for employment according to the invention are polymethyl methacrylate beads produced for example by the pearl polymerization process, glass beads produced by normal fabrication process, or similar colorless particles 34. These particles 34 may be employed as such, or may have applied thereon, by the molecular dispersion or particle dispersion process, a colored layer 35 constituted by coloring matter such as dye or pigment, thereby producing coated translucent particles 36, as shown in FIG. 12. Alternatively, there may be employed colored translucent particles 37 which are constituted by colored glass beads produced by the normal process or which, as illustrated in FIG. 13, are produced by pelletization of a dispersion consisting of dye, pigment, or similar coloring matter which is dispersed by the molecular or particle dispersion method in a bonding agent having good transparency. Examples of such bonding agent include acryl resin, styrene resin, epoxy resin, melamine resin, gelatine, nitrocellulose, acetyl cellulose, or polyvinyl alcohol.

Other examples of translucent particles which may be advantageously employed according to the method of the invention include translucent particles which include therein one or more development agents and are produced by dispersion of an electron acceptor substance constituting a development agent, for example activated clay, bis-phenyl A, 2,2'-dihydroxy diphenol, 3-hydroxy-3-phenylic acid, or naphthol AS-D, in a bonding agent having good transparency, and subsequent pelletization of this dispersion. Alternatively, there may be employed translucent particles which contain a colorless dye substance. Such particles are produced by dispersion in a bonding agent such as described above, by the molecular dispersion or particle dispersion process, of a dye material such as triphenyl methane leuco dye, tri-azene dye, phenadiene dye, or stilbene dye, which dye is normally colorless but becomes colored upon reaction thereof with a developing agent such as noted above, and subsequent pelletization of this dispersion. Another method of fabrication is to disperse developing agent and/or colorless dye which is in the form of microcapsules in the transparent bonding agent, then to pelletize this dispersion to constitute translucent particles.

A type of particle, which is particularly advantageous for production of color copies, is a colored translucent particle such as described above, which has incorporated therein or is coated with a normally colored subliming dye or a colorless subliming dye which becomes colored upon reaction with a developing agent such as described above. A colorless subliming dye is preferable in many cases since, being normally almost completely colorless, it has little effect on the light resolution characteristics of the colored translucent particle. If this type of colored translucent particle is employed, the coloring matter therefor must be of a type which does not sublime when the subliming dye provided in or on the particle sublimes, and any bonding agent employed must be of a type which is not liable to soften or melt under conditions in which the subliming dye sublimes. More specifically, the coloring matter and bonding agent should both be unaffected by a temperature of 200° C. when subjected thereto for 30 seconds.

The translucent particles employed are suitably spherical and have a particle diameter from a few microns up to 80 microns.

Next are described representative examples of coloring agents employable for imparting specific spectral characteristics to translucent particles employed in the method of the invention. To impart transparency to red light, dyes which may be suitably employed include C.I. (Colour Index Code) amido red 5, C.I. amido red 14, C.I. amido red 94, C.I. solvent red 127, and C.I. solvent red 132. To impart transparency to green, dyes which may suitably be employed include C.I. amido green 9, C.I. amido green 27, Kayacion Green A-49 (manufactured by Nippon Kayaku, Inc. of Japan), and Aizen Spilon Green C-GH (manufactured by Hodogaya Kagaku Kogyo, Inc. of Japan). To impart transparency to blue light, dyes which may be suitably employed include C.I. amido blue 23, C.I. amido blue 40, C.I. solvent blue 48, C.I. solvent blue 49, and C.I. direct blue 87. Pigments which may be suitably employed to impart transparency to red light include C.I. pigment red 17, C.I. pigment red 48, and C.I. pigment red 81. Pigments which may be suitably employed to impart transparency to green light include C.I. pigment green 2, C.I. pigment green 7, and C.I. vat green 1. Pigments which may be suitably employed to impart transparency to blue include C.I. pigment violet 3, C.I. basic violet 3, C.I. pigment blue 15, and C.I. vat blue 4. These pigments are suitably employed after being reduced in a crusher, pulverizer or similar equipment to fines having a diameter of the order of from 0.01 to 0.15 microns, since, even when pigments having high obliterating power are employed, if the pigments are reduced to this range of sizes and then are dispersed in a transparent bonding agent, pelletization of this dispersion results in colored particles which are translucent.

Colored subliming dyes which may be employed according to the invention include, to obtain cyan include C.I. basic blue 5, C.I. solvent blue 2, C.I. disperse blue 1, and C.I. disperse blue 3; to obtain magenta, C.I. basic violet 14, C.I. disperse violet 1, C.I. disperse red 56, C.I. solvent red 3, and C.I. solvent red 24; and, to obtain yellow, C.I. basic yellow 2, C.I. disperse yellow 2, C.I. disperse yellow 51, and Oil Yellow=240 (manufactured by Yamamoto Kagaku Gosei, Inc. of Japan).

As colorless subliming dyes which become colored upon reaction with an electron acceptor substance, there may be suitably employed, for example, to give yellow, Michler's ketone, a reduction product of auramine, a leuco-auramine dye such as bis (4-dimethyl amino phenyl) methyl-N ethyl aniline or N-bis (4-dimethyl phenyl) methyl-(4-$\beta$-hydroxy ethyl) aniline, or an astrazone dye such as 2-(4'-hydroxy) styryl-3,3-dimethyl-3H-indole or 2-(2',4'-methoxy anilino-vinylene)-3,3-dimethyl-3H-indole; to give magenta, a phenadiene dye such as 2,7-di(dimethyl amino)-phenadiene or 2-amino-7-methyl phenadiene, a fluorane dye such as 3-dialkyl amino-benzo-fluorane, or an astrazone dye such as 2-(omega-substituted vinylene)-3,3-2 substituted-3H-indole or 2-[4'-(N-cyano ethyl, N-methyl) amino styryl]-3,3-dimethyl-3H-indole; and, to give cyan, a stilbene dye such as bis(4,4'-dialkyl amino-diphenyl)ethylene, bis(4,4'-diethyl amino-diphenyl) ethylene, 1,4,5,8-tetra-amino anthraquinone, 1-methyl amino-4-ethanol amino anthraquinone, N-bis(P-dimethyl amino phenyl)-methyl-m-hydroxy methyl aniline, or N-bis (4-dialkyl amino phenyl)-methyl-$\beta$-hydroxy ethyl aniline.

It is preferable in general that the subliming dye substances employed sublime at a temperature in the range 80° C.–220° C., and for the production of colour copies in particular, it is preferable that combined use be made of dye materials that sublime in closely similar conditions, i.e., if for example the dye material employed to give magenta sublimes at a comparatively low temperature, the dye materials employed to give cyan and yellow also should be materials which sublime at a comparatively low temperature.

Suitable developing agent employable to develop the abovenoted colorless subliming dyes include fatty acids such as activated clay, tartaric acid, bis-phenol A(4,4'-isopropyridene diphenol), oxalic acid, or behenic acid, 2,2'-dioxy diphenyl, methyl succinic acid, DL-mandelic acid, acetyl salicylate, benzilic acid, polyester resin, acrylic acid resin, phenyl-phenol resin, maleic acid resin, or similar electron acceptor substances.

According to the invention there may be suitably employed as photoconductive base material on which the above-described particles are spread a metallic plate constituted by a photoconductive substance such as selenium, a selenium-tellurium alloy, zinc oxide, cadmium sulfide, titanium sulfide, poly-N-vinyl carbazole, or poly-N-vinyl anthracene, which is sputtered, evaporated, or otherwise applied on a a conductive support base constituted by metallized paper, metal-coated film, or paper or similar material having applied thereon by evaporation or other known process a polyelectrolyte such as a polysalt of quaternary ammonia. When necessary, the photoconductive material employed includes a color sensitizer or chemical sensitizer. For production of color images in particular, panchromatic sensitization of the photoconductive material is effected.

The description continues with reference to several specific examples of the invention, it being understood that the scope of the invention is by no means limited to the exact details of the examples described.

EXAMPLE 1

To serve as translucent particles there were prepared glass beads which were almost perfectly spherical and had diameters in the range of from 5 microns to 37 microns. The photosensitive base plate was prepared as follows. 150 parts by weight of zinc oxide in the form of SAZEK 4000 (a product manufactured by the Sakai Kagaku Kogyo, Inc. of Japan) was added to 100 parts by weight of a 30% toluene solution of XPL-2005 (a polyester resin manufactured by the Kao Soap Co., Ltd. of Japan). Through mixing of these components was effected and the resulting solution was applied as a film approximately 20 microns thick on aluminized paper.

After this, the photosensitive base plate was negatively charged to a potential of between −6 kw and −7 kw by means of a corona discharge unit. Then the glass beads were spread on the photosensitive plate, and excess beads were removed, to produce a single layer of beads packed with close to maximum density on the photosensitive plate, this layer of beads being held by the force of electrostatic attraction to the photosensitive plate. The whole unit, i.e., the photosensitive plate together with the glass beads, was then exposed for 5 seconds to image-wise light coming from an original document constituted by a transparent sheet of paper having a black and white content defined thereon and illuminated by an iodine lamp. After such illumination, the photosensitive plate was vibrated in order to remove irradiated glass beads, leaving on the photosensitive plate non-irradiated glass beads which defined a positive print corresponding to the content of the original document. The tone reproduction of this print was Grade 8.

EXAMPLE 2

10 g of the red dye Mitsui Brilliant Milling Red BL (manufactured by the Mitsui Toatsu Chemicals, Inc. of Japan) was dissolved in 200 g of a 5% aqueous solution of polyvinyl alcohol, and the resulting solution was then supplied into an atomization and heating mill wherein it was formed into particles which were classified by a standard sieve to obtain particles having diameters in the range of from 37 microns to 44 microns to serve as colored translucent particles transparent to red light only, particles having diameters outside this range being rejected.

Next, a panchromatic photosensitive base plate was prepared by evaporating a 20 to 40 micron thick film of a selenium-tellurium alloy on a 0.1 mm thick plate of aluminum.

This photosensitive base plate was positively charged in a dark location to a potential of +5 kv to +6 kv by a corona discharge unit, after which the abovedescribed colored particles were spread thereon. Excess particles which could not be held by electrostatic force to the plate were shaken off, whereby there was obtained on the plate a single layer of particles which were held electrostatically to the plate and were packed thereon with approximately maximum density.

The whole unit was then exposed for 3 seconds in an enlarger to image-wise light coming from a positive color slide illuminated by a 500 W incandescent lamp. Development of the exposed unit, i.e., removal of photoattenuated particles, were effected by means of a magnetic brush having attached to magnetized portions thereof iron powder of 200 to 300 mesh in size, thereby producing a particle image which gave the same color resolution through a red filter as the original slide.

EXAMPLE 3

Translucent particles including colorless dye were prepared by pearl polymerization of a thoroughly mixed solution containing 5 parts by weight of the colorless leuco dye crystal violet lactone added to and thoroughly mixed with 100 parts by weight of methyl acrylate monomer. The particles thus prepared were classified in a standard sieve to select particles having diameters in the range of from 25 microns to 37 microns.

These selected particles were applied on a zinc oxide photosensitive plate, exposed to image-wise light, and developed in the manner described in Example 1. The particle image produced was then placed in flat contact with a previously prepared sheet of transfer paper consisting of bis-phenol A coated on high grade paper, and the photosensitive plate and sheet of transfer paper were pressed together and heated for 6 seconds by a pair of iron plates which were heated to a temperature of 150° C. This resulted in a reaction between the crystal violet lactone and the bis-phenol A and production of a blue-colored print of the original document on the transfer paper.

EXAMPLE 4

An aqueous solution of the melamine resin Sumitex Resin M-3 (manufactured by the Sumitomo Chemical Co., Ltd. of Japan) and the hardening agent Sumitex Accelerator EPX (also manufactured by the Sumitomo Chemical Co., Ltd. of Japan) which in their solid states were in the proportion 100:8 by weight, was introduced into an atomizing and heating mill to produce colorless translucent particles, only particles having diameters in the range of from 5 microns to 80 microns being employed in the subsequent process. For each 100 parts by weight of these particles, there was introduced into a mortar 3 parts by weight of a 30% methanol solution of DANSTAT-ET80, which is a bonding agent in the form of a polysalt of a quaternary ammonium compound and is manufactured by Dainippon Shikizai Inc., of Japan and 5 parts by weight of the blue subliming dye PTB-52 (manufactured by the Mitsubishi Chemical Industries, Ltd. of Japan). These materials were thoroughly mixed and simultaneously dried in the mortar, and then applied as an overcoat on the above described particles, whereby translucent particles coated with subliming dye were produced.

These coated particles were employed to produce a particle image on a zinc oxide photosensitive plate, following the same procedure as in Example 1, the particles constituting the particle image were heated for 10 seconds by an iron plate which was heated to 190° C., after which the particles were brushed off the photosensitive plate, leaving a blue-colored print of an original document on the plate.

EXAMPLE 5

A particle image obtained by the same procedure as in Example 4 was placed in contact with a negatively charged sheet of polyethylene phthalate and after electrostatic transfer thereof to the polyethylene phthalate sheet, the polyethylene phthalate sheet was laid in flat contact with a sheet of clay paper in the form of Mitsubishi Milton (manufactured by Mitsubishi Paper Mills, Ltd.), and these sheets were then pressed together and heated for 10 seconds by iron plates which were at a temperature of 190° C. This resulted in production of a blue-colored print on the sheet of clay paper.

EXAMPLE 6

The translucent particles employed were particles of polymethyl methacrylate having diameters in the range of from 30 microns to 70 microns, which were prepared by the pearl polymerization process and whose surfaces were coated with a 0.01–1 micron thick film of bonding agent in the form of the colorless subliming dye bis-(4,4'-dialkyl amino—diphenyl) ethylene. The photosensitive plate was prepared by adding to 100 parts by weight of a 30% toluene solution of a styrene-butadiene copolymer 150 parts by weight of zinc oxide in the form of SAZEX 4000 (manufactured by the Sakai Kagaku Kogyo, Inc. of Japan) and 6 parts by weight of activated clay, introducing these various components into a ball mill, causing thorough mixing thereof in the ball mill, then applying the resulting solution in a layer 10–30 microns thick on a sheet of aluminized paper.

The photosensitive plate was negatively charged in a dark location to a potential of −6 kv to −7 kv by means of a corona discharge unit, the translucent particles were applied thereon, and excess particles not holdable thereon by electrostatic force were brushed off to leave an approximately single layer of particles on the plate. After this, the particles were exposed for 5 seconds to image-wise light directed through a black and white transparent original document illuminated by an iodine lamp, and photo-attenuated particles were caused to fall off the photosensitive plate by vibration of the plate, thus producing a positive image defined by non-irradiated particles remaining in adherence to the plate. Next, the plate was heated to approximately 150° C. by an infrared lamp, and the remaining particles were brushed off the plate by means of a hair brush, there now being obtained on the plate a cyan-colored print constituting a copy of the original document.

EXAMPLE 7

1 part by weight of green pigment which was in the form of Dainichi Fast Green BG Toner BGX (manufactured by the Dainichiseika Color and Chemicals Mfg. Co., Ltd. of Japan) which had been pulverized to a particle size of 0.02 micron to 0.1 micron was added to 200 parts by weight of a 5% acetone solution (9:1) of acetyl cellulose L-30 (manufactured by the Daicel Co., Ltd. of Japan) in a ball mill, wherein the components were throughly mixed. The resulting solution was then atomized and dried to form colored particles transparent to green light. Then, for each 100 parts by weight of these particles, there was introduced into a mortar 5 parts by weight of 2-amino-7-dimethyl phenadiene, which is a colorless subliming dye able to develop magenta, and 50 parts by weight of a 1% toluene solution of styrene resin, which constitutes a bonding agent. These components were thoroughly mixed and simultaneously dried in the mortar and then applied as an overcoat on the abovedescribed particles, so producing colorless translucent particles coated with colorless subliming dye. These particles were classified in a standard sieve to select particles having diameters in the range of from 20 microns to 37 microns. Only particles in this size range were being employed in the subsequent process.

The selected particles were then employed in association with a selenium-tellurium photosensitive plate to produce a particle image, following the procedure of Example 2, after which the particle image was transferred onto a sheet of active clay coated paper of the type employed in Example 5 by pressing the photoconductive plate and sheet of active clay coated paper together for 10 seconds by means of iron plates heated to 160° C. This resulted in production on the sheet of active clay coated paper of a magenta-colored print which was the same as the image of the original document seen through a green filter.

EXAMPLE 8

First red, green, and blue solutions having the following compositions were prepared.

| | parts by weight |
|---|---|
| (1) Red solution | |
| (a) EPICLON H-157 (an epoxy resin manufactured by the Dainippon Ink and Chemicals, Inc. of Japan) | 80 |
| (b) Super Beckamin (a butylated melamine resin manufactured by the Dainippon Ink and Chemicals, Inc. of Japan) | 20 |
| (c) Sulpho Rhodamine B conc (manufactured by the Hoechst, Inc.) | 4.4 |
| (d) Spilon Yellow NB-1 (manufactured by the Hodogaya Chemical Co., Ltd, of Japan) | 2.8 |
| (e) Methyl Cellosolve (a diluent) | 100 |
| (2) Green solution | |
| (a) EPICLON H-157 | 80 |
| (b) Super Beckamin J-840 | 20 |
| (c) Spirit Blue = 1 (manufactured by the Yamamoto Kagaku Gosei, Inc. of Japan | 4 |
| (d) Spilon Yellow NB-1 | 6 |
| (e) Methyl | 100 |
| (3) Blue solution | |
| (a) EPICLON H-157 | 80 |

-continued

| | parts by weight |
|---|---|
| (b) Super Beckamin J-840 | 20 |
| (c) Spirit Blue = 1 | 5 |
| (d) Sulpho Rhodamine B conc | 1.6 |
| (e) Acid Violet 6B (manufactured by the Kanto Kagaku, Inc. of Japan) | 1.6 |

The above-noted solutions were separately atomized and dried to produce red, green, and blue translucent particles having diameters in the range of from 5 microns to 80 microns.

These different colored particles were then separately introduced together with solutions having the compositions noted below into mortars, in which the particles and corresponding solutions were thoroughly mixed, while being simultaneously dried, after which the resulting particles were classified to obtain translucent particles having diameters in the range of from 20 microns to 37 microns, to be used for the production of color images.

| | parts by weight |
|---|---|
| (4) Red-transparent particles | |
| (particles transparent to red light) | |
| (a) Red colored translucent particles | 100 |
| (b) Cyan colorless subliming dye: bis (4,4'-dialkyl amino-diphenyl)ethylene | 5 |
| (c) 20% aqueous solution of Alafix 200 (polyamide resin manufactured by Arakawa Rinsan Kagaku Kogyo, Inc. of Japan) | 5 |
| Water | 20 |
| (5) Green-transparent particles | |
| (a) Green colored translucent particles | 100 |
| (b) Magenta colorless subliming dye: N-bis(p-dimethyl amino phenyl)-methyl-m-hydroxy methyl aniline | 3 |
| (c) 20% aqueous solution of Alafix 200 | 5 |
| (d) Water | 20 |
| (6) Blue-transparent particles | |
| (a) Blue colored translucent particles | 100 |
| (b) Yellow colorless subliming dye: Michler's ketone | 6 |
| (c) 20% aqueous solution of Alafix 200 | 5 |
| (d) Water | 20 |

Next, the following substances were thoroughly mixed in a ball mill and then were applied on a sheet of aluminized paper, to constitute a zinc oxide photosensitive plate for production of a color image.

| (7) substances | parts by weight |
|---|---|
| (a) SAZEX-2000 (zinc oxide manufactured by the Sakai Kagaku Kogyo, Inc. of Japan) | 100 |
| (b) Acryldick 6-1036 (bonding agent manufactured by the Dai-Nippon Ink and Chemicals Inc. of Japan) | 20 |
| (c) Sensitizers: | |
| (i) Solar Pure Yellow 8G (manufactured by the Sumitomo Chemical Co., Ltd. of Japan) | 0.5 |
| (ii) Rose bengal | 0.01 |
| (iii) Alizarine Cyanine Green GWA (manufactured by the Mitsubishi Chemical Industries, Ltd. of Japan) | 0.02 |
| (d) Toluene | 100 |

Next, equal quantities of the red-transparent, green-transparent, and blue-transparent particles were mixed and applied to this photosensitive plate, which had been electrically charged in the manner described in Example 1. Exposure to image-wise light carrying the image of a positive color slide was effected in an enlarger in the manner described in Example 2, after which image development was effected by vibrating the photosensitive plate in order to remove photo-attenuated particles. Next, the photosensitive plate carrying the particle image was placed in flat contact with a sheet of active clay coated paper such as employed in Example 5, and the sheet of paper and photosensitive plate were pressed together and heated for 5 seconds by iron plates heated to 190° C. This caused sublimation and suitable diffusion of the colorless subliming dyes associated with the different types of particles and resulted in production of a clear color print on the sheet.

EXAMPLE 9

Three separate solutions, A, B, and C, were prepared as follows. 10 g of Mitsui Brilliant Red BL (a red dye manufactured by the Mitsui Toatsu Chemicals, Inc. of Japan) and 1.5 g of bis(4,4'-dialkyl amino-diphenyl-)ethylene, which is a colorless subliming dye developable to give cyan, were added to 200 g of a 5% aqueous solution of polyvinyl alcohol, and thoroughly mixed therein to give solution A. 13 g of Suminole Milling Cyan Green 6G (a green dye manufactured by the Sumitomo Chemical Co., Ltd. of Japan) and 1.2 g of 2-(4-N,N-diethyl amino-2-methyl styryl)-3,3-dimethyl-3H-indole, which is a colorless subliming dye developable to give magenta, were added to and thoroughly mixed together with 200 g of a 5% aqueous solution of polyvinyl alcohol to give solution B. 8 g of Aizen Victoria Blue (a blue dye manufactured by the Hodogaya Chemical Co., Ltd. of Japan) and 2 g of Michler's Ketone, which is a colorless subliming dye developable to give yellow, were added to and thoroughly mixed with a 5% aqueous solution of polyvinyl alcohol to give solution C.

The solutions A, B, and C were separately atomized and dried to produce red particles R, green particles G, and blue particles B having diameters in the range of from 37 microns to 44 microns. Equal quantities of particles R, particles G, and particles B were taken, mixed, and then employed in association with a zinc oxide photosensitive plate such as employed in Example 8 to obtain a color copy of a color slide, the procedure being the same as that of Example 8 except that duration of exposure was 15 seconds, temperature of the iron plates employed for effecting transfer of the particle image was 170° C., and duration of application of heat and pressure by the plates was 10 seconds.

As is clear from the above description, by employment of translucent image-defining particles the method of the invention ensures efficient photo-attenuation of requisite particles and hence clearly defined images in copies of documents, slides, etc. This is as opposed to conventional methods employing opaque particles which cannot be guaranteed to be correctly photo-attenuated. resulting in poorly defined outlines of figures or letters. Use of translucent particles permitting efficient photo-attenuation thereof also provides the advantage that the stage of preparation of a photosensitive base plate is greatly facilitated, since, unlike photosensitive plates employed in conventional methods, the plate need not be perfectly smooth as perfect ohmic contact between the plate an image-defining particles is not essential.

The invention presents further advantages with respect to production of color images since the problem of sensitizing particles equally with respect to red, blue, and green light and simultaneously maintaining uniform photo-attenuation characteristics thereof is avoided and production of good quality color images is ensured simply by employing general-purpose dye materials in association with different particles and by making use of a panchromatized photosensitive plate in easily effected processes. In addition, since use of colored toner as well as image-defining particles having specific spectral characteristics is unnecessary in the method of the invention, the manufacture of color image materials is further simplified, and there are less variables in the color image production process, thus permitting control and steady production of color images of high quality to be effected more easily.

The process of production of color images is also greatly simplified since only one exposure stage and only one development stage need be effected. Thus only simple equipment is required and the time to produce color copies of documents is greatly reduced.

What is claimed is:

1. Image formation method comprising steps of:

a. imparting a charge to a photoconductive member combined with an electrically conductive support member;

b. spreading on the surface of the charged photoconductive member a mixture of particles comprising at least one type of non-photoconductive, translucent particles containing a coloring agent and a colorless dye which is capable of developing a color different from that transmitted by said translucent particles;

c. causing said translucent particles to electrostantially adhere to said surface through electrostatic attraction;

d. subjecting the charged photoconductive member bearing said translucent particles to light image exposure through said translucent particles, thereby selectively weakening and attenuating the charge on a portion of said photoconductive member below said translucent particles through which the light of said light image has passed, whereby the electrostatic attraction of said particles to said photoconductive member is selectively weakened in relation to the degree of said light exposure;

e. exerting a force on said translucent particles to remove those translucent particles with selectively weakened attraction for said photoconductive member and to thereby obtain a particle image; and f. bringing said particle image into close contact with a color developing agent which develops said colorless dye into a color different from that transmitted by said translucent particles.

2. The method according to claim 1 wherein said colorless dye is sublimable.

3. The method according to claim 2 wherein said image is developed by bringing said particle image into close contact with an image-receiving material containing a color developing agent and applying heat to said particle image whereby said colorless sublimable dyestuff sublimes onto said image receiving material to form a colored image by reaction with said developing agent.

4. The method according to claim 1 wherein said mixture is composed of particles of at least two kinds of non-photoconductive translucent particles, each of said at least two kinds of non-photoconductive translucent particles being capable of transmitting and developing relatively different kinds of colors with respect to each other.

5. The method according to claim 1 wherein said mixture is composed of particles of a first non-photoconductive translucent material containing a sublimable colorless dye which only transmits red light and which develops the color cyan, a second non-photoconductive translucent material having sublimable colorless dye which only transmits green light and which develops the color magenta; and a third non-photoconductive translucent material having sublimable colorless dye which only transmits blue light and which develops the color yellow.

6. The method according to claim 1 wherein said force exerted on said translucent particles is a vibratory force.

7. The method according to claim 1 wherein said force exerted on said translucent particles is an electrostatic force.

8. The method according to claim 1 wherein said force exerted on said translucent particles is the force of air caused by an air-jet.

9. The method according to claim 2 wherein said colorless agent is not sublimable under conditions in which the sublimable dye sublimes.

10. The method according to claim 3 wherein said colorless agent is not sublimable under conditions in which the sublimable dye sublimes.

* * * * *